US010052677B2

(12) United States Patent
Takahashi et al.

(10) Patent No.: US 10,052,677 B2
(45) Date of Patent: Aug. 21, 2018

(54) SPRING FORMING DEVICE AND FORMING METHOD THEREFOR

(71) Applicant: NHK SPRING CO., LTD., Yokohama-shi, Kanagawa (JP)

(72) Inventors: Keita Takahashi, Yokohama (JP); Tohru Shiraishi, Yokohama (JP); Yuichiro Ono, Fussa (JP); Kaoru Nagasawa, Yokohama (JP)

(73) Assignee: NHK SPRING CO., LTD., Yokohama-shi (JP)

( * ) Notice: Subject to any disclaimer, the term of this patent is extended or adjusted under 35 U.S.C. 154(b) by 0 days.

(21) Appl. No.: 15/027,393

(22) PCT Filed: Oct. 8, 2014

(86) PCT No.: PCT/JP2014/076914
§ 371 (c)(1),
(2) Date: Apr. 5, 2016

(87) PCT Pub. No.: WO2015/056615
PCT Pub. Date: Apr. 23, 2015

(65) Prior Publication Data

US 2016/0243607 A1 Aug. 25, 2016

(30) Foreign Application Priority Data

Oct. 18, 2013 (JP) ..... 2013-217889

(51) Int. Cl.
*B21F 11/00* (2006.01)
*B21F 35/00* (2006.01)
(Continued)

(52) U.S. Cl.
CPC ..... *B21F 35/00* (2013.01); *B21F 3/06* (2013.01); *B21F 11/005* (2013.01); *B21F 23/00* (2013.01); *B21F 99/00* (2013.01); *H05B 6/101* (2013.01)

(58) Field of Classification Search
CPC .. B21F 3/02; B21F 3/06; B21F 11/005; B21F 23/00; B21F 35/00
See application file for complete search history.

(56) References Cited

U.S. PATENT DOCUMENTS

2006/0196242 A1 9/2006 Tsuritani
2014/0311204 A1* 10/2014 Sigg ..... B21F 3/02 72/139

FOREIGN PATENT DOCUMENTS

CN 2044524 U 9/1989
JP S60-181235 U 12/1985
(Continued)

OTHER PUBLICATIONS

Jan. 6, 2015 Search Report issued in International Patent Application No. PCT/JP2014/076914.
(Continued)

*Primary Examiner* — Debra Sullivan
(74) *Attorney, Agent, or Firm* — Oliff PLC

(57) ABSTRACT

A spring forming device in which the steel wire can be continuously cut off without stopping the feeding of the steel wire in cutting, and in which the steel wire can be uniformly heated, is provided. The spring forming device has a wire supplying mechanism for supplying a steel wire using a plurality of feeding rollers, a heating mechanism for heating the steel wire, a coiling mechanism for forming in a coil state the heated steel wire, and a cutting mechanism for cutting the steel wire coiled at a given number of turns off the steel wire remained backward. A cutting blade of the cutting mechanism follows tracks having a speed Va that moves to
(Continued)

the receiving blade and a speed Vc that moves in an axial direction of the coiled steel wire, in cutting of the steel wire.

4 Claims, 3 Drawing Sheets

(51) Int. Cl.

| | |
|---|---|
| ***B21F 23/00*** | (2006.01) |
| ***B21F 3/06*** | (2006.01) |
| ***B21F 99/00*** | (2009.01) |
| ***H05B 6/10*** | (2006.01) |

(56) References Cited

FOREIGN PATENT DOCUMENTS

| | | | |
|---|---|---|---|
| JP | H07-115101 | B2 | 12/1995 |
| JP | 2004-330209 | A | 11/2004 |
| JP | 2008-080386 | A | 4/2008 |

OTHER PUBLICATIONS

Apr. 27, 2017 Office Action issued in Chinese Patent Application No. 201480055675.4.
Mar. 1, 2017 Office Action issued in Japanese Patent Application No. 2013-217889.

* cited by examiner

SPRING FORMING DEVICE AND FORMING METHOD THEREFOR

BACKGROUND OF THE INVENTION

Technical Field

The present invention relates to a spring forming device in which a spring such as a coil spring is continuously hot-formed while feeding a steel wire, and in particular, it relates to a technique in which uneven heating of the steel wire is decreased by continuously cutting the steel wire without stopping the feeding thereof.

Background Art

Recently, in transportation equipment, in particular, in an automobile, requirements for reducing fuel consumption are annually increased in consideration of global warming, and size reduction and weight reduction of automobile parts is required more stringently than ever. In order to satisfy this requirement for size reduction and weight reduction, for example, in compression coil spring parts such as a valve spring used in an engine, a clutch damper spring used in a clutch, etc., attempts were made up until now to improve fatigue resistance or settling resistance, which are important characteristics of the coiled spring, by strengthening or surface-treating materials.

Generally comparatively small coiled springs such as a valve spring, a clutch damper spring, etc., are produced by cold-forming using coil material. In contrast, comparatively large springs such as a suspension spring are generally produced by hot-forming using bar material. This is one reason it is difficult to form since workability in the cold-forming is low due to thick wires being used.

None of them can be selected as better forming, since there are some advantages and some disadvantages in the cold-forming and the hot-forming of the coiled spring. For example, in a coiled spring in a shape which can be cold-formed since a wire diameter is comparatively small or a spring index is large, the cold-forming is generally adopted from the viewpoint of the ease of processing technique and the mass-productiveness (tact, dimensional accuracy, cost) due to machining speed, equipment cost, etc. Additionally, in the cold-forming, a forming technique using coreless material is established, and high flexibility of a shape of the coiled spring is also one of the large causes of use of the cold-forming. In general, springs of a valve spring class are produced by cold-forming.

On the other hand, hot-forming has an advantage in which coiling distortion does not occur in processing, in comparison with the cold-forming, and when a wire diameter d is large or when a spring index D/d which is a ratio of a coil average diameter D per a wire diameter d is small, it is used in forming of the coiled spring which cannot be cold-formed due to low workability. However, in the hot-forming, it is necessary to form a coiled spring in a coiled shape by winding around a core bar since the material is soft. Therefore, the flexibility of the shape is low, and moreover, the core bar must be arranged in each product.

In hot-forming, a shape or performance of the product is greatly affected by heating temperature in forming of the steel wire. Therefore, in order to maintain the quality (form accuracy, grain size) of the product, it is desirable that the steel wire be formed in a state in which it is uniformly heated over the whole. That is, it is desirable that the feeding speed of the steel wire, which affects the heating temperature, be made more uniform.

Patent Document 1 discloses a mechanism in which a motor for driving a cutting tool carries out a reciprocating motion and a rotary motion, a coiled spring is cut in not only a forward motion but also a backward motion of the motor for driving a cutting tool, and therefore, the coiled spring can be cut at a higher speed.

Patent Document 1 is Japanese Unexamined Patent Application Publication No. 2008-080386.

DISCLOSURE OF THE INVENTION

Problems Solved by the Invention

In a coiling machine for cold-forming, supply of the steel wire is generally stopped in cutting the spring. Also in the technique described in Patent Document 1, supply of the steel wire is stopped in cutting.

However, in the hot-forming, there was a problem that heating times of the steel wire are different between during feeding and during non-feeding when once feeding of the steel wire is stopped in cutting, and as a result, the steel wire cannot be uniformly heated and required quality cannot be ensured. In addition, as described above, generally, hot-forming is carried out with respect to a bar material and the cold-forming is carried out with respect to a coiled material. When the hot-forming is forcibly carried out in spring forming of a valve spring class which uses the coiled material, the fact is that the hot-forming has not been used until now, since there is the above problem.

Therefore, an object of the present invention is to provide a spring forming device in which the steel wire can be continuously cut off without stopping the feeding of the steel wire in cutting, and in which the steel wire can be uniformly heated.

Means for Solving the Problems

The spring forming device according to the present invention comprises a wire supplying mechanism for supplying a steel wire using a plurality of feeding rollers, a heating mechanism for heating the steel wire, a coiling mechanism for forming the heated steel wire into a coil, and a cutting mechanism for cutting the steel wire coiled at a given number of turns off the steel wire remained backward, wherein the coiling mechanism comprises a wire guide for inducing the steel wire supplied by the feeding rollers to an appropriate position in a processing portion, a coiling tool for processing the steel wire supplied through the wire guide to a coiled shape, and a pitching tool for forming pitches on the steel wire in a coiled shape, the cutting mechanism comprises a cutting blade for cutting the steel wire coiled at a given number of turns off the steel wire remained backward, and a receiving blade for supporting the steel wire arranged opposite to the cutting blade, a region for heating the steel wire in the heating mechanism is arranged between the feeding rollers and the wire guide, and the cutting blade follows tracks having a speed Va that moves to the receiving blade and a speed Vc that moves in an axial direction of the coiled steel wire, in cutting of the steel wire.

In the present invention, since the cutting blade follows tracks having a speed Va that moves to the receiving blade and a speed Vc that moves in an axial direction of the coiled steel wire, in cutting of the steel wire, the steel wire can be continuously fed, for example, at a speed close to the speed Vc even in cutting. Therefore, non-uniformity of heating time of the steel wire by the heating mechanism is prevented, and heating temperature of the steel wire is made further uniform.

Here, the feeding speed of the steel wire can also be decreased in cutting of steel wire. However, in the case in which the feeding speed of the steel wire in cutting is extremely slow, large differences occur between heating temperature in cutting and heating temperature in other than cutting. As a result, temperature differences occur depending on positions on the coiled spring to be hot-formed, and quality (shape, structure, etc.) in the coiled spring is not made uniform. Alternatively, when the temperature difference is larger, the steel wire buckles due to excessive heating. Therefore, the feeding speed of the steel wire in cutting is preferably 50% or more of the feeding speed in other than cutting, and it is more preferably 90% or more.

It is desirable that in the case in which the feeding speed of the steel wire in cutting is Vw, the relationship $Vc>Vw$ be satisfied. That is, when the speed Vc, which moves in an axial direction of the cutting blade, is lower than the feeding speed Vw of the steel wire, a cut surface of the steel wire is pressed by a flank of the cutting blade, and as a result, the steel wire buckles and cannot be coiled. When the relationship $1.1>Vc/Vw>1$ is satisfied, the degree in which the cut surface of the steel wire is pressed by the flank of the cutting blade is decreased, and the roundness of a terminal coil diameter deteriorates, although the steel wire can be coiled. Therefore, in order to avoid such inconvenience, it is desirable that the relationship $Vc/Vw\geq1.1$ be satisfied. Additionally, it is desirable that the relationship $2.5\geq Vc/Vw$ be satisfied. Further improvement cannot be anticipated, even if the relationship Vc/Vw exceeds 2.5, and cost of equipment for moving the cutting blade at a high speed is increased.

The speed Vc at which the cutting blade moves in an axial direction of the steel wire may be constant until the steel wire is cut. When the speed Va at which the cutting blade moves to the receiving blade is constant, the cutting blade moves obliquely and straightly to the steel wire. Alternatively, the cutting blade may also move so as to follow tracks of an ellipse or circle.

First, it is desirable that the heating mechanism be a high frequency heating mechanism, and it is desirable that a coil length of the heating coil coaxially arranged with the steel wire be 100 to 350 mm. When the coil length of the heating coil is not more than 100 mm, a heating performance for sufficiently heating to the inside of the steel wire cannot be ensured, and in the case in which the feeding speed of the steel wire is high or in the case in which the steel wire diameter is large, it is difficult to heat the steel wire to an austenite range. Therefore, by using a heating coil having a coil length of 100 mm or more and heating the steel wire to the austenite range for 2.5 seconds or less, austenite crystal grains are prevented from coarsening, and a refinement effect is obtained due to rapid heating. As a result, springs having superior durability can be produced. Here, the coiled spring is heated to an austenite range and is coiled, and then, it is hardened and annealed.

In contrast, when the coil length of the heating coil exceeds 350 mm, a distance between the feeding rollers and the wire guide which support the steel wire is increased too, and therefore, there is a risk that the steel wire is rolled between them, that is, in the heating coil, and that buckling will occur.

In order to arrange the above heating coil, it is desirable that a space distance between a feeding roller and a receiving blade be 200 to 500 mm. When the space distance between the feeding roller and the receiving blade is not more than 200 mm, a region for containing a heating coil having a length with sufficient heating capacity and a wire guide which induces a steel wire to a suitable position in a coiling processing portion cannot be secured. In contrast, when the space distance between the feeding roller and the receiving blade exceeds 500 mm, it is uneconomical since a length of the wire guide is too long.

According to the present invention, the steel wire can be continuously cut off without stopping the feeding of the steel wire in cutting, and it can be more uniformly heated, and a spring, which is of a valve spring class can be produced by hot-forming.

EXPLANATION OF REFERENCE NUMERALS

Figure 1:
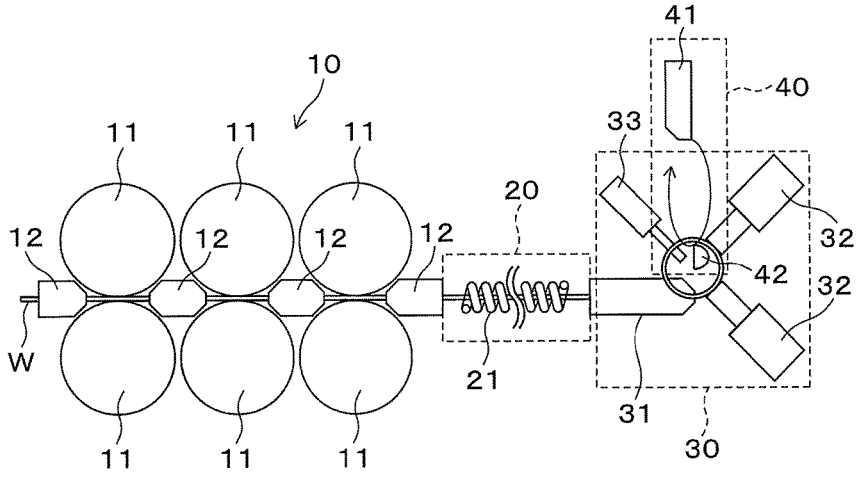
FIG. 1 is a side view showing a coiling machine in an embodiment of the present invention.
Figure 2:
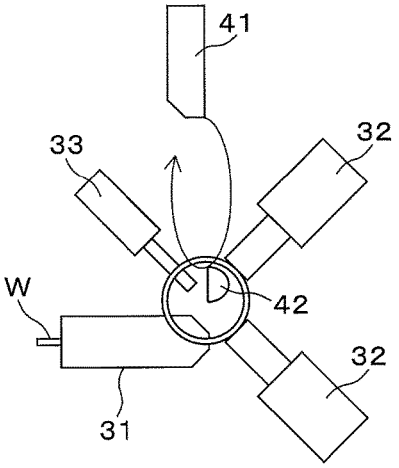
FIG. 2 is a side view showing a coiling mechanism in an embodiment of the present invention.

Reference numeral 10 denotes a wire supplying mechanism, 11 denotes a feeding roller, 20 denotes a heating mechanism, 21 denotes a high frequency heating coil, 30 denotes a coiling mechanism, 31 denotes a wire guide, 32 denotes a coiling tool, 33 denotes a pitching tool, 40 denotes a cutting mechanism, 41 denotes a cutting blade, 42 denotes a receiving blade, and W denotes a steel wire.

MODE FOR CARRYING OUT THE INVENTION

In the following, embodiments of the present invention will be explained with reference to FIGS. 1 to 4. Reference numeral 10 in FIG. 1 denotes a wire supplying mechanism. The wire supplying mechanism 10 has a plurality of feeding rollers 11 which are continuously provided in a horizontal direction. Wire guides 12 for guiding a steel wire W are arranged between the feeding rollers 11.

A heating mechanism 20 is arranged at a downstream side of the wire feeding mechanism 10. The heating mechanism 20 has a spiral high frequency heating coil 21 coaxially placed to the steel wire W. The steel wire W is heated to an austenite range for 2.5 seconds or less by the high frequency heating coil 21. Here, the high frequency heating coil 21 is not limited to a spiral coil shown in FIG. 1, and it may use coils in a suitable shape for heating performance and setup performance, such as a coil in a channel shape in which a side in an axial cross section is opened, etc.

A coiling mechanism 30 is arranged at a downstream side of the heating mechanism 20. Reference numeral 31 in the figures denotes a wire guide, and the wire guide 31 induces the steel wire W supplied by the feeding rollers 11 to an appropriate position in the coiling mechanism 30. A coiling tool 32 consisting of two coiling pins (or coiling rollers) and a pitching tool 33 for forming pitches are arranged at a downstream side of the wire guide 31. The steel wire W that passed through the wire guide 31 is bent at a given curvature by contacting with a first coiling tool 32, and furthermore, it is bent at a given curvature by contacting with a next coiling tool 32 at a downstream side. Then, pitches are formed to the steel wire W by contacting with the pitching tool 33, so as to form a desired coiled shape. Here, the coiling tool 32 may also be an aspect having one coiling pin (or coiling roller).

Figure 4A:
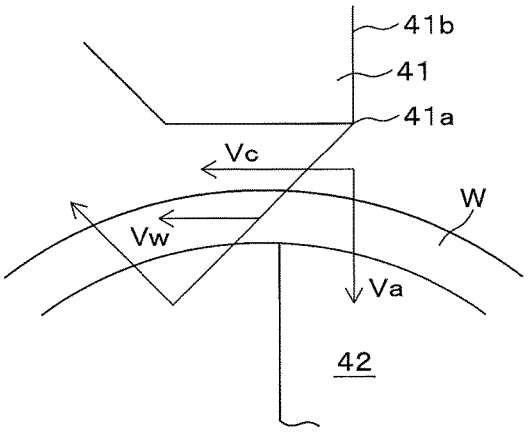
FIG. 4 is a side view showing tracks of a cutting blade in an embodiment of the present invention.

Reference numeral 40 in the figures denotes a cutting mechanism. The cutting mechanism 40 has a cutting blade 41 which can be vertically moved by a crank mechanism (not shown). The cutting blade 41 can be horizontally moved by a moving mechanism (not shown). In this manner, when the cutting blade 41 moves downward as shown in FIG. 4A, it moves at a speed Va which moves downward and a speed Vc which moves in a horizontal direction (a left direction in the figure), and an edge 41*a* of the cutting blade 41 is inserted obliquely downward into the steel wire W, so that it follows tracks of a straight line. The speed Vc is set to be faster than a speed Vw at which the steel wire W is fed in cutting.

Figure 3:
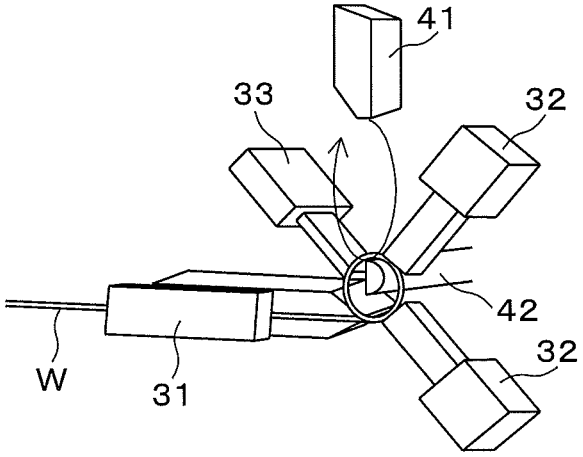
FIG. 3 is a perspective view showing a coiling mechanism in an embodiment of the present invention.

A receiving blade 42 is arranged downward of the cutting blade 41. The receiving blade 42 functions as a lower blade, and it is supported in a cantilever state in the cutting mechanism 40, as shown in FIG. 3. The cutting blade 41 moves downward when the steel wire W is bent by the coiling tool 32 until a number of turns is attained at a given value, and the coiled steel wire W is cut off a steel wire W supplied from a rear side by shearing between the cutting blade 41 and a straight portion of the receiving blade 42. Here, after the steel wire W is cut by the cutting blade 41, as shown in FIG. 4A, interference with the steel wire W is avoided by moving the cutting blade 41 at almost right angles to a moving direction thereof.

In the spring forming device having the above structure, the cutting blade 41 follows tracks having a speed Va that moves downward and a speed Vc that moves in a horizontal direction, in cutting of the steel wire W, and the steel wire W is fed at a speed Vw without stopping the moving. Therefore, non-uniformity of heating time of the steel wire W by the heating mechanism 20 is avoided, and heating temperature of the steel wire W is made further uniform. In the case in which the speed Vw in cutting is closer to the feeding speed when the steel wire W is heated and coiled while feeding, the non-uniformity of the heating time of the steel wire W is further avoided.

In particular, in the above embodiment, the cutting blade 41 moves at speed Va, which moves downward, and the speed Vc, which moves in a horizontal direction; however, the feeding speed Vw in an axial direction in the cutting of the steel wire W is smaller than the speed Vc. Therefore, the cutting blade 41 moves in a feeding direction at a faster speed than that of a cut surface of the steel wire W, and as a result, deformation of the cut surface is prevented without pressing the cut surface of the steel wire W by a flank 41*b* of the cutting blade 41, and the roundness of the coil diameter is improved.

Figure 4B:
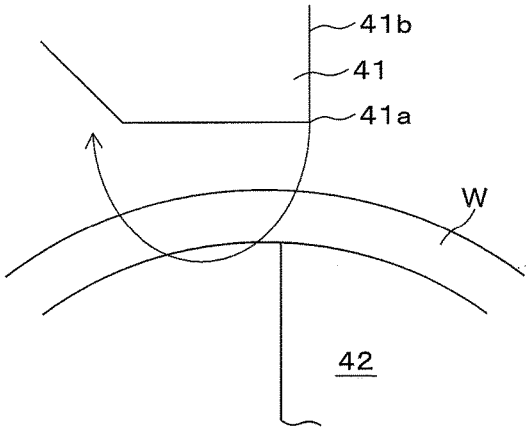
Figure 4C:
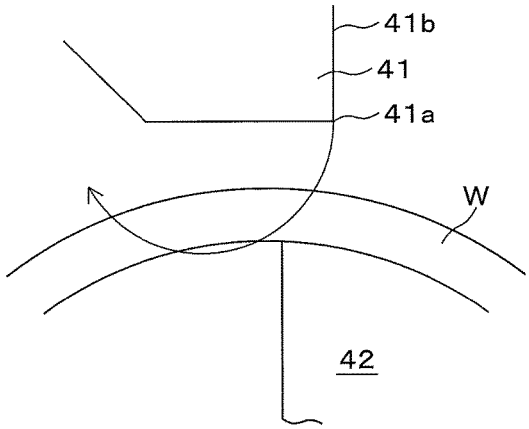

Here, in the above embodiment, the cutting blade 41 is moved linearly and obliquely downward; however, the cutting blade 41 is not limited in this manner, and it may carry out optional motion. For example, the cutting blade 41 may carry out an oval motion as shown in FIG. 4B. Alternatively, it may carry out a rotary motion as shown in FIG. 4C. Such motion of the cutting blade 41 is realized by guiding the cutting blade 41 in a reciprocating motion between a top dead center and a bottom dead center.

EXAMPLES

Next, examples of the present invention will be explained by verifying numerical limitations in preferable aspects thereof. Spring forming devices and forming conditions of springs in Examples are shown below.

Length of a heating coil: 170 mm
Space distance between a feeding roller and a receiving blade: 400 mm
Oscillating frequency of a high frequency heating coil: 200 kHz
Feeding speed of a steel wire in coil forming: 40 to 50 m/min
Feeding speed of a steel wire in coil cutting: 8 to 50 m/min
Speed Vc in a vertical direction of a cutting blade: 40 to 120 m/min
Diameter of a steel wire: 2 to 5 mm
Heating temperature: 900 degrees centigrade
Average diameter of coils per diameter of a steel wire: 6.0
Number of turns: 5.75

Example 1

Crystal grain sizes and coil outer diameters of coiled springs which were produced while feeding speed in cutting off of steel wire was changed from 8 to 50 m/min, are shown in Table 1. In the Examples of the present invention, in the case in which feeding speed (a) in cutting off of steel wire was the same as feeding speed (b) in forming of steel wire, and in the case in which feeding speed (a) in cutting off of steel wire was 90% of feeding speed (b) in forming of steel wire, there was no difference between crystal grain size at both edge portions of a coil and crystal grain size at an effective portion of the coil, and grain size number thereof was 12.2. In addition, coil outer diameters at the both edge portions and the effective portion of the coil were the same. Furthermore, in the case in which feeding speed (a) in cutting off of steel wire was 50% of feeding speed (b) in forming of steel wire, the grain size number was 10.5 and was sufficient, and a difference of coil outer diameters between both edge portions and the effective portion of the coil was in an allowable range. Therefore, it was confirmed that feeding speed in cutting off of the steel wire was preferably 50 to 100% of the feeding speed in coiling of the steel wire, and that it was more preferably 90 to 100% thereof.

TABLE 1

| | | | Feeding speed of wire | | | Crystal grain size (G) | | Coil outer diameter (mm) | | |
|---|---|---|---|---|---|---|---|---|---|---|
| | Nos. | Wire diameter (mm) | a in cutting off | b in forming | a/b (%) | Both edge portions | Effective portion | Both edge portions | Effective portion | Note |
| Examples | 1 | 4 | 40 | 40 | 100 | 12.2 | 12.2 | 28.7 | 28.7 | |
| | 2 | 4 | 36 | 40 | 90 | 12.2 | 12.2 | 28.7 | 28.7 | |
| | 3 | 4 | 32 | 40 | 80 | 11.8 | 12.2 | 28.6 | 28.7 | |
| | 4 | 4 | 28 | 40 | 70 | 11.5 | 12.3 | 28.6 | 28.7 | |
| | 5 | 4 | 20 | 40 | 50 | 10.5 | 12.1 | 28.5 | 28.7 | |
| | 6 | 4 | 50 | 50 | 100 | 12.2 | 12.2 | 28.7 | 28.7 | |
| Comparative | 7 | 4 | 16 | 40 | 40 | 9.9 | 12.2 | 28.3 | 28.7 | |

TABLE 1-continued

| | Nos. | Wire diameter (mm) | Feeding speed of wire: a in cutting off | Feeding speed of wire: b in forming | Feeding speed of wire: a/b (%) | Crystal grain size (G): Both edge portions | Crystal grain size (G): Effective portion | Coil outer diameter (mm): Both edge portions | Coil outer diameter (mm): Effective portion | Note |
|---|---|---|---|---|---|---|---|---|---|---|
| Examples | 8 | 4 | 8 | 40 | 20 | — | — | — | — | not coiling (buckling) |

In contrast, in Comparative Examples in which the feeding speed (a) in cutting off of the steel wire was not more than 50% of the feeding speed (b) in forming of the steel wire, a difference of heating temperature between the both edge portions and the effective portion of the steel coil was increased, and the both edge portions were excessively heated. As a result, crystal grains were coarsened, and grain size number was 10 or less. Additionally, a difference of the coil outer diameter was 0.4 mm or more, and required qualities were not satisfied. In particular, in Comparative Example in which the feeding speed (a) in cutting off of the steel wire was not more than 20% of the feeding speed (b) in forming of the steel wire, buckling occurred, and therefore, coiling could not be carried out.

Example 2

Roundness of coil diameters at a coiling start side terminal of coiled springs, produced while Vc/Vw was changed from 1.00 to 3.00, is shown in Table 2.

TABLE 2

| | Nos. | Wire diameter (mm) | Vc (m/min) | Vw (m/min) | Vc/Vw | Roundness (mm) | Note |
|---|---|---|---|---|---|---|---|
| Examples | 1 | 4 | 44 | 40 | 1.10 | 1.000 | |
| | 2 | 4 | 50 | 40 | 1.25 | 1.000 | |
| | 3 | 4 | 70 | 40 | 1.75 | 1.000 | |
| | 4 | 4 | 100 | 40 | 2.50 | 1.000 | |
| | 5 | 2 | 50 | 40 | 1.25 | 1.000 | |
| | 6 | 5 | 50 | 40 | 1.25 | 1.000 | |
| | 7 | 4 | 75 | 50 | 1.50 | 1.000 | |
| | 8 | 4 | 120 | 40 | 3.00 | 1.000 | Over specification |
| | 9 | 4 | 42 | 40 | 1.05 | 0.995 | Terminal deformation |
| Comparative Example | 10 | 4 | 40 | 40 | 1.00 | — | Not coiling (buckling) |

In Examples 1 to 9 in which Vc/Vw was 1.05 to 2.50, in the case in which the steel wire diameter was 2 to 5 mm (in the present invention, it was a diameter in the case in which roundness was calculated from a cross sectional area of the steel wire, and it contained the case in which a circle equivalent diameter including a non-circular cross section such as a rectangle, an ellipse, etc., was 2 to 5 mm), the coiling could be carried out when the roundness was 0.995 to 1.000. In particular, in Examples 1 to 8 in which Vc/Vw was 1.10 to 2.50, the roundness was 1.000, there was no terminal deformation at all, and the coiling could be carried out.

Steel wires having a diameter of 1.5 to 9 mm except for samples shown in Table 2, could be hot-coiled. That is, when the steel wire diameter was not more than 1.5 mm, the strength as a steel wire was low, and as a result, the steel wire could often not be coiled due to deformation or buckling in coiling, etc. Therefore, in order to improve yield rate, it is preferable that the steel wire diameter be 1.5 mm or more. However, in order to further improve the yield rate by more surely preventing the deformation or the buckling in coiling, it is desirable that the steel wire diameter be 2 mm or more.

In contrast, when the steel wire diameter exceeded 9 mm, incomplete hardening portions remained from the vicinity of a surface of the steel wire having high load stress to the inside of the steel wire. Therefore, it was desirable that the steel wire diameter be 9 mm or less. When the steel wire diameter exceeded 5 mm and was 9 mm or less, the incomplete hardening portions remained from the vicinity of the center of the steel wire. However, there was no problem in using the steel wire as a coiled spring, since the load stress was low in the vicinity of the center of the steel wire. Furthermore, in order to form a spring having a homogeneous structure over the whole area to the inside of the steel wire, it was more desirable that the steel wire diameter was 5 mm or less.

In Comparative Example 10 in which Vc/Vw was 1.00, the steel wire was buckled, and the coiling could not be carried out. In Example 8 in which Vc/Vw was 3.00, the roundness was the same as those of Examples 1 to 7; however, it was uneconomical since equipment for increasing Vc was over specification. That is, in Example 8, it was necessary to have a high-performance motor in which a cutting blade was driven, and as a result, it was uneconomical. Therefore, it was desirable that Vc/Vw exceed 1.00 and be 2.50 or less, as in those of Examples 1 to 7 and 9, and in order to form a coiled spring having high accuracy (roundness), it was more desirable that it be 1.10 to 2.50 as in those of Examples 1 to 7.

The invention claimed is:

1. A method for forming spring, comprising a heating step for heating a steel wire while feeding the steel wire, a coiling step for coiling the heated steel wire in a coiled shape, and a cutting step for cutting the steel wire coiled at a given number of turns off the steel wire remained backward, wherein the cutting step is carried out by a receiving blade and a cutting blade which closes and separates to the receiving blade, and the cutting blade follows tracks, has a speed Va that moves to the receiving blade and has a speed Vc that moves in an axial direction of the coiled steel wire, in cutting of the coiled steel wire, and wherein when the steel wire is cut off by the cutting blade, a feeding speed Vw of the steel wire and the speed Vc of the cutting blade are controlled satisfying the relationship $Vc/Vw \geq 1.1$.

2. The method for forming the spring according to claim 1, wherein roundness of coil diameters at a coiling start side terminal of a coiled spring is set to be substantially 1.0.

3. The method for forming the spring according to claim 1, wherein the steel wire is heated to an austenite range for 2.5 seconds or less.

4. The method for forming the spring according to claim 1, wherein both ends of the coiled steel wire are provided with a grain size number of 10.5 or more.

* * * * *